US011739940B2

(12) United States Patent
Davison et al.

(10) Patent No.: US 11,739,940 B2
(45) Date of Patent: Aug. 29, 2023

(54) COOKING APPLIANCE HAVING A REMOVABLE CONTROL PANEL

(71) Applicants: BSH Home Appliances Corporation, Irvine, CA (US); BSH Hausgeräte GmbH, Munich (DE)

(72) Inventors: Daniel Davison, Knoxville, TN (US); Charles Hanna, Knoxville, TN (US); James Russell, Knoxville, TN (US); Tyson White, Anderson, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 345 days.

(21) Appl. No.: 16/505,758

(22) Filed: Jul. 9, 2019

(65) Prior Publication Data

US 2021/0010676 A1 Jan. 14, 2021

(51) Int. Cl.
*F24C 3/12* (2006.01)
*G05G 1/10* (2006.01)

(52) U.S. Cl.
CPC ..... *F24C 3/124* (2013.01); *F24C 3/122* (2013.01); *G05G 1/10* (2013.01)

(58) Field of Classification Search
CPC ..... F24C 3/122; F24C 3/124; F24C 3/126; G05G 1/10
See application file for complete search history.

(56) References Cited

U.S. PATENT DOCUMENTS

| | | | | |
|---|---|---|---|---|
| 2,851,029 | A * | 9/1958 | Fry | F24C 15/08 126/39 B |
| 5,738,424 | A * | 4/1998 | Katz | D06F 39/12 312/293.3 |
| 5,864,120 | A | 1/1999 | Vroom et al. | |
| 6,371,583 | B1 * | 4/2002 | Visin | D06F 39/12 312/228 |
| 9,903,598 | B2 | 2/2018 | Greenwood et al. | |
| 2005/0178164 | A1 * | 8/2005 | Kim | D06F 34/28 68/3 R |

FOREIGN PATENT DOCUMENTS

| | | | | |
|---|---|---|---|---|
| CN | 202960178 | U * | 6/2013 | |
| DE | 3520272 | A1 | 12/1986 | |
| DE | 3621260 | A1 | 1/1988 | |
| DE | 3624654 | A1 | 1/1988 | |
| DE | 8813044 | U1 | 5/1989 | |
| EP | 1795642 | B1 | 12/2006 | |
| EP | 2172143 | B1 | 10/2009 | |
| JP | 60016235 | A * | 1/1985 | F24C 7/082 |
| WO | WO-2018121951 | A1 * | 7/2018 | F24C 3/124 |

* cited by examiner

*Primary Examiner* — Michael G Hoang
*Assistant Examiner* — Logan P Jones
(74) *Attorney, Agent, or Firm* — Michael E. Tschupp; Brandon G. Braun; Andre Pallapies

(57) ABSTRACT

A removable control panel console for a cooking appliance may include a front panel having upper fingers that hook onto apertures in a bullnose feature of the appliance. The control panel console is pivotable in this configuration, and may be secured to the appliance by raising the front panel to fully insert the fingers into the apertures and fastening a bottom wall of the control panel to the appliance. Side walls of the control panel console may include tabs that are received into corresponding slots in a front surface of the appliance, providing an additional alignment and security feature.

12 Claims, 7 Drawing Sheets

COOKING APPLIANCE HAVING A REMOVABLE CONTROL PANEL

FIELD

This disclosure relates to systems and methods for providing a removable control panel console for a cooking appliance. More specifically, the disclosed embodiments relate to removable control panel consoles for stoves.

INTRODUCTION

Cooking appliances such as gas stoves must be serviced from time to time. Often, servicing and accessibility of electronics in and behind the appliance's control panel can be difficult or cumbersome, due to the need to remove large portions of the appliance or to reposition the appliance away from its installed location. This type of activity introduces a higher risk of damage to appliance components, for example the housing, bullnose, and rear accessories.

SUMMARY

The present disclosure provides systems, apparatuses, and methods relating to cooking appliances having removable range control panels.

In some embodiments, a cooking appliance may include a stove having a cooktop mounted above an oven; a bullnose extending from a front of the cooktop; and a removable control panel console including one or more user interface (UI) elements mounted to a front face of the control panel console and configured to control the cooktop, wherein bottom, left, and right walls extend orthogonally from the front face, and a plurality of spaced-apart fingers extend upward from a top edge of the front face, the fingers having hooked distal ends; wherein the control panel console is transitionable between (a) a first configuration, in which the hooked distal ends of the fingers are engaged with bottom edges of corresponding apertures in a bottom flange of the bullnose, such that the bottom wall of the control panel console is free to pivot away from the stove, and (b) a second configuration, in which the top edge of the control panel console abuts a bottom of the bullnose and the bottom wall is secured to the stove.

In some embodiments, a stove may include: a cooktop having a cooktop chassis mounted above an oven; a bullnose extending from a front of the cooktop, the bullnose including a downward-extending vertical flange having a plurality of spaced-apart apertures; and a removable control panel console including one or more user interface (UI) elements mounted to a front face of the control panel console and configured to control the cooktop, wherein bottom, left, and right walls extend orthogonally from the front face, one or more tabs protrude from distal edges of the left and right walls, and a plurality of spaced-apart fingers extend upward from a top edge of the front face; wherein the fingers of the control panel console are received by the apertures of the flange of the bullnose, the tabs of the left and right walls are received in corresponding slots of the front of the cooktop, and the bottom wall of the control panel console is removably fastened to a floor of the cooktop chassis.

In some embodiments, a method for selectively coupling a control panel to a cooking appliance may include: hanging hooked ends of one or more fingers extending from a top edge of a front face of a control panel onto bottom edges of a corresponding one or more apertures in a downward-extending flange of a bullnose of a housing of a stove, such that a lower end of the control panel is pivotable toward and away from a face of the stove; pivoting the lower end of the control panel toward the face of the stove; lifting the control panel upward, such that the one or more fingers extend upward and behind the flange of the bullnose until the top edge of the front face of the control panel abuts the bullnose; and securing the control panel in place by fastening a bottom wall of the control panel to the stove.

Features, functions, and advantages may be achieved independently in various embodiments of the present disclosure, or may be combined in yet other embodiments, further details of which can be seen with reference to the following description and drawings.

DETAILED DESCRIPTION

Figure 1:
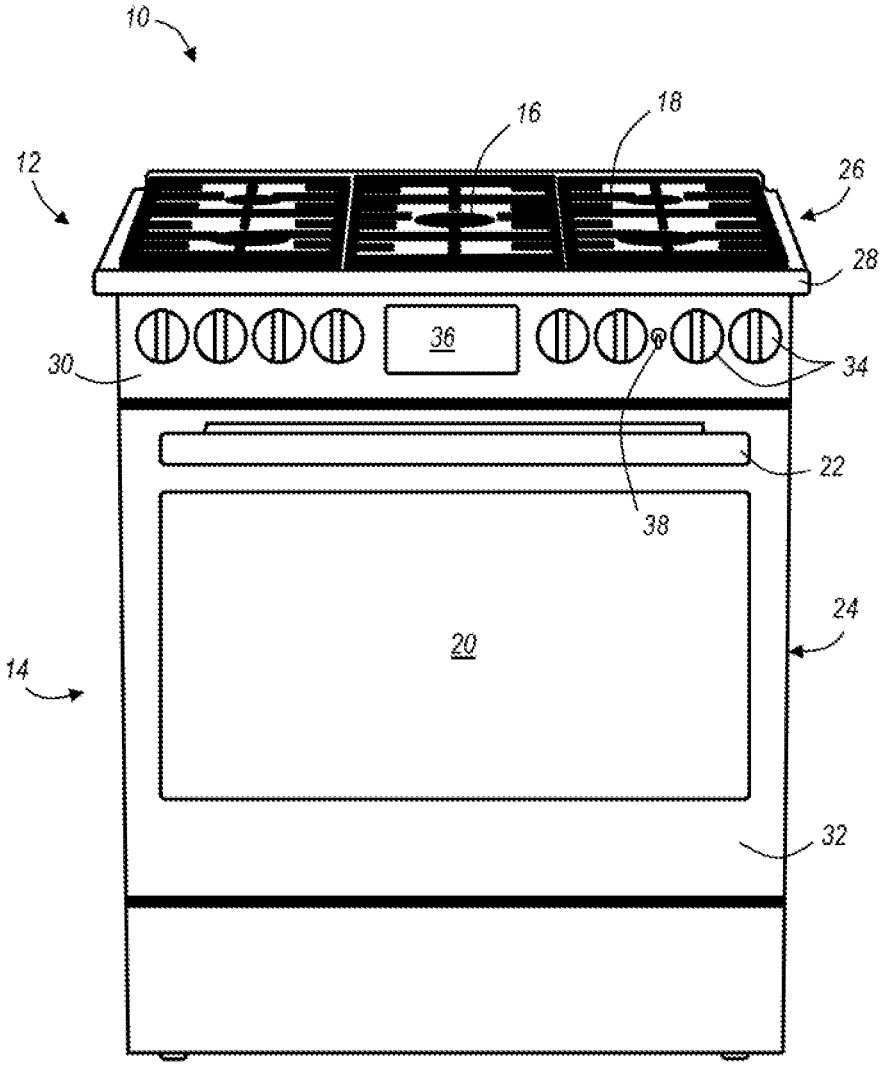
FIG. 1 is a schematic front perspective view of an illustrative cooking appliance suitable for use with removable control panel consoles in accordance with aspects of the present disclosure.

Various aspects and examples of a cooking appliance having a removable control panel console, as well as related methods, are described below and illustrated in the associated drawings. Unless otherwise specified, a control panel console in accordance with the present teachings, and/or its various components, may contain at least one of the structures, components, functionalities, and/or variations described, illustrated, and/or incorporated herein. Furthermore, unless specifically excluded, the process steps, structures, components, functionalities, and/or variations described, illustrated, and/or incorporated herein in connection with the present teachings may be included in other similar devices and methods, including being interchangeable between disclosed embodiments. The following description of various examples is merely illustrative in nature and is in no way intended to limit the disclosure, its application, or uses. Additionally, the advantages provided by the examples and embodiments described below are illustrative in nature and not all examples and embodiments provide the same advantages or the same degree of advantages.

This Detailed Description includes the following sections, which follow immediately below: (1) Definitions; (2) Overview; (3) Examples, Components, and Alternatives; (4) Advantages, Features, and Benefits; and (5) Conclusion. The Examples, Components, and Alternatives section is further divided into subsections A through D, each of which is labeled accordingly.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional, unrecited elements or method steps.

Terms such as "first", "second", and "third" are used to distinguish or identify various members of a group, or the like, and are not intended to show serial or numerical limitation.

"AKA" means "also known as," and may be used to indicate an alternative or corresponding term for a given element or elements.

"Coupled" means connected, either permanently or releasably, whether directly or indirectly through intervening components.

Directional terms such as "up," "down," "vertical," "horizontal," and the like should be understood in the context of the particular object in question, in its standard context.

For example, an object may be oriented around defined X, Y, and Z axes. In those examples, the X-Y plane will define horizontal, with up being defined as the positive Z direction and down being defined as the negative Z direction.

Overview

In general, a cooking appliance according to the present teachings may include a range control panel configured to be removable to access components of the cooktop chassis. The range control panel, also referred to as a console, a control panel, or a control panel console, may include several features to enhance accessibility while preventing misalignment and damage to the panel or other elements of the appliance's housing. Accordingly, servicing and accessibility of electronics in and behind the range control panel is improved. Electronics in and near the control panel can be serviced without the removal of the main top of the range, which would introduce a higher risk of scratches, e.g., to the bullnose, side panels, and rear accessory.

In known devices, one or more spark ignition modules corresponding to the surface burners of the cooktop are typically mounted to the cooktop chassis floor and serviced through the main top. However, in examples described herein, the spark modules may be mounted to a front portion of the cook top manifold, freeing up much needed space in the cooktop chassis. The removable range control panel of the present disclosure provides straightforward access to components mounted near the control panel, such as the aforementioned spark modules, without needing to further disassemble or reposition the appliance.

Among other features and advantages, removable control panels of the present disclosure include one or more of the following aspects, each of which aids in serviceability while maintaining alignment to the bullnose and side panels of the appliance housing:

a. The appliance bullnose is permanently mounted to the housing, while the control panel fits into a bottom feature of the bullnose. During assembly, the control panel may appear to be hinged at the bottom of the bull nose.

b. A top edge of the control panel console may include fingers that mate with slots in the bullnose, facilitating horizontal alignment. The fingers may have small flanges or hooks at distal ends, which cause the control panel console hang from the bullnose during assembly or maintenance, e.g., while electronics are wired.

c. The control panel console may include tabs configured to fit into corresponding slots in a front edge of the housing side panel. These tabs may also aid in maintaining horizontal alignment of the control panel console with respect to the range housing.

d. The bottom of the control panel sits substantially lower than the front lip of the cooktop chassis floor. When fastened together, the control panel console is pushed up into the bottom of the bull nose, effectively adjusting vertical alignment of the control panel console.

Through these and/or other features described below, electronics within and immediately behind the control panel can quickly be serviced by a technician without removing the main top. Moreover, the assembly process is made more efficient and flexible.

Examples, Components, and Alternatives

The following sections describe selected aspects of exemplary cooking appliances with removable control panel consoles, as well as related systems and/or methods. The examples in these sections are intended for illustration and should not be interpreted as limiting the scope of the present disclosure. Each section may include one or more distinct embodiments or examples, and/or contextual or related information, function, and/or structure.

A. Illustrative Cooking Appliance

As shown in FIG. 1, this section describes an illustrative cooking appliance 10 suitable for use with control panel consoles of the present disclosure. Cooking appliance 10 is an example of the cooking appliances described in the Overview above.

Cooking appliance 10 comprises a stove having a gas cooktop 12 mounted above an oven 14. Cooktop 12 includes one or more gas burners 16, above which are mounted grates 18 to support cookware and other devices that may be placed thereon for cooking and heating purposes. Oven 14 has a door 20, pivotably operable by a manual handle 22 to provide access to an oven cavity within.

The stove includes an appliance housing 24 comprising, e.g., stainless steel, and configured to enclose, at least in sections, the oven chassis, the cooktop chassis, and other internal components. An upper portion of housing 24 includes a hob 26, a bullnose 28, and a control panel console 30. A lower portion of housing 24 includes an oven enclosure 32.

Gas flow to each burner 16 and/or oven 14 is controlled by one or more user interface (UI) elements disposed on control panel console 30. UI elements may include any suitable human-machine interface configured to receive an input and provide an output to control an aspect of the appliance. UI elements may, for example, include one or more manipulable controls such as a lever, dial, switch, slider, pushbutton, keypad, and/or knob, any of which may be implemented electronically, mechanically, and/or virtually (such as via a graphical user interface (GUI) on a screen or other display). In some examples, UI elements may include a touch control (e.g., a capacitive touch control, such as those having a wheel or slider interface). In some examples, an input to the appliance (e.g., a controller of the appliance) may be provided remotely, e.g., wirelessly over a Bluetooth® wireless or WiFi connection, by a wireless UI element. Wireless UI elements may include, for example, a voice interface capable of speech recognition, through which the operator may provide voice commands to the controller. In some examples, wireless UI elements may include the interface of a software application (AKA an "app") running on a portable or wearable computing device, such as an article of clothing or a wrist- or head-mounted interface, or a mobile digital device (e.g., a smartphone or tablet). In this example, the UI elements include rotatable knobs 34, a display 36, and a toggle switch 38.

B. Illustrative Control Panel Console

As shown in FIGS. 2-7, this section describes an illustrative control panel console 100. Control panel console 100 is an example of control panel console 30 of appliance 10 and of the control panels described in the Overview, above.

Figure 2:
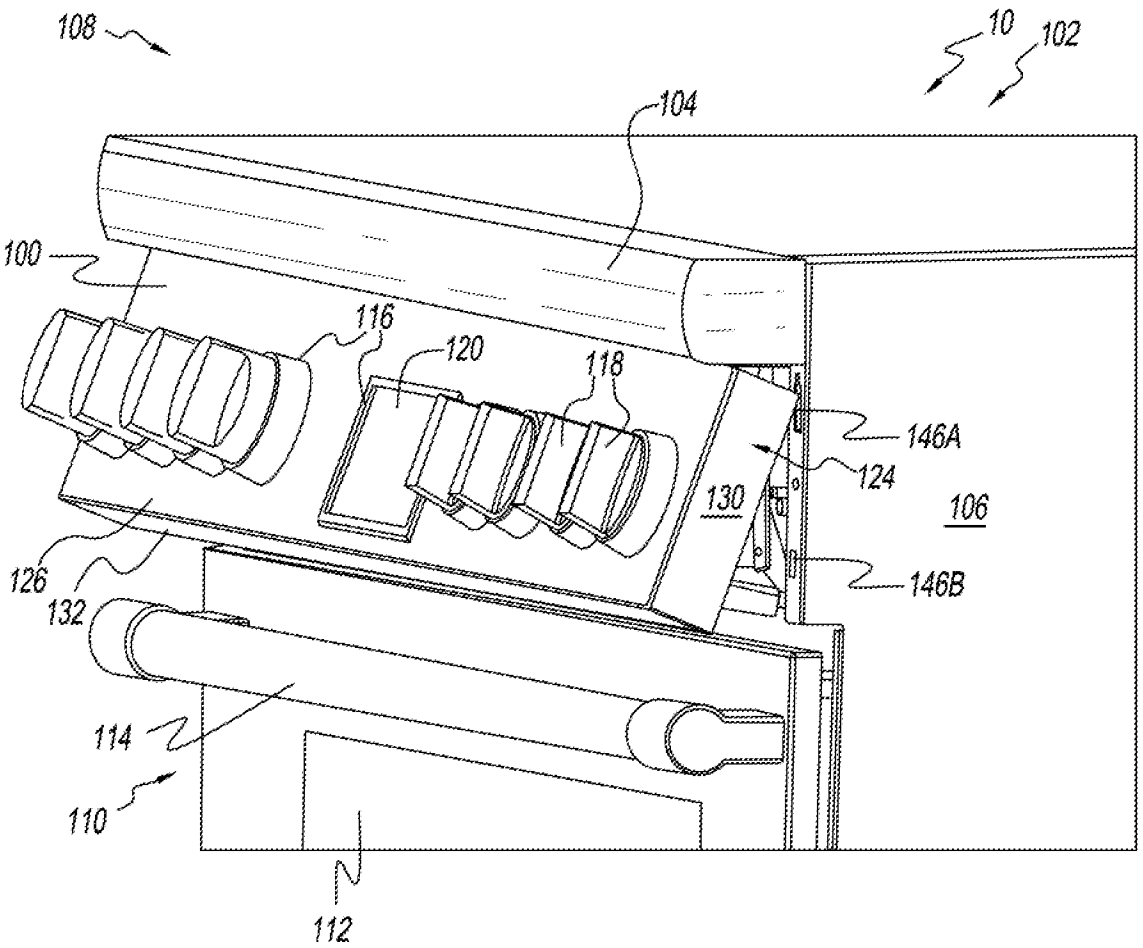
FIG. 2 is an isometric view of a stove comprising an illustrative control panel console, with the control panel pivoted outward.
Figure 3:
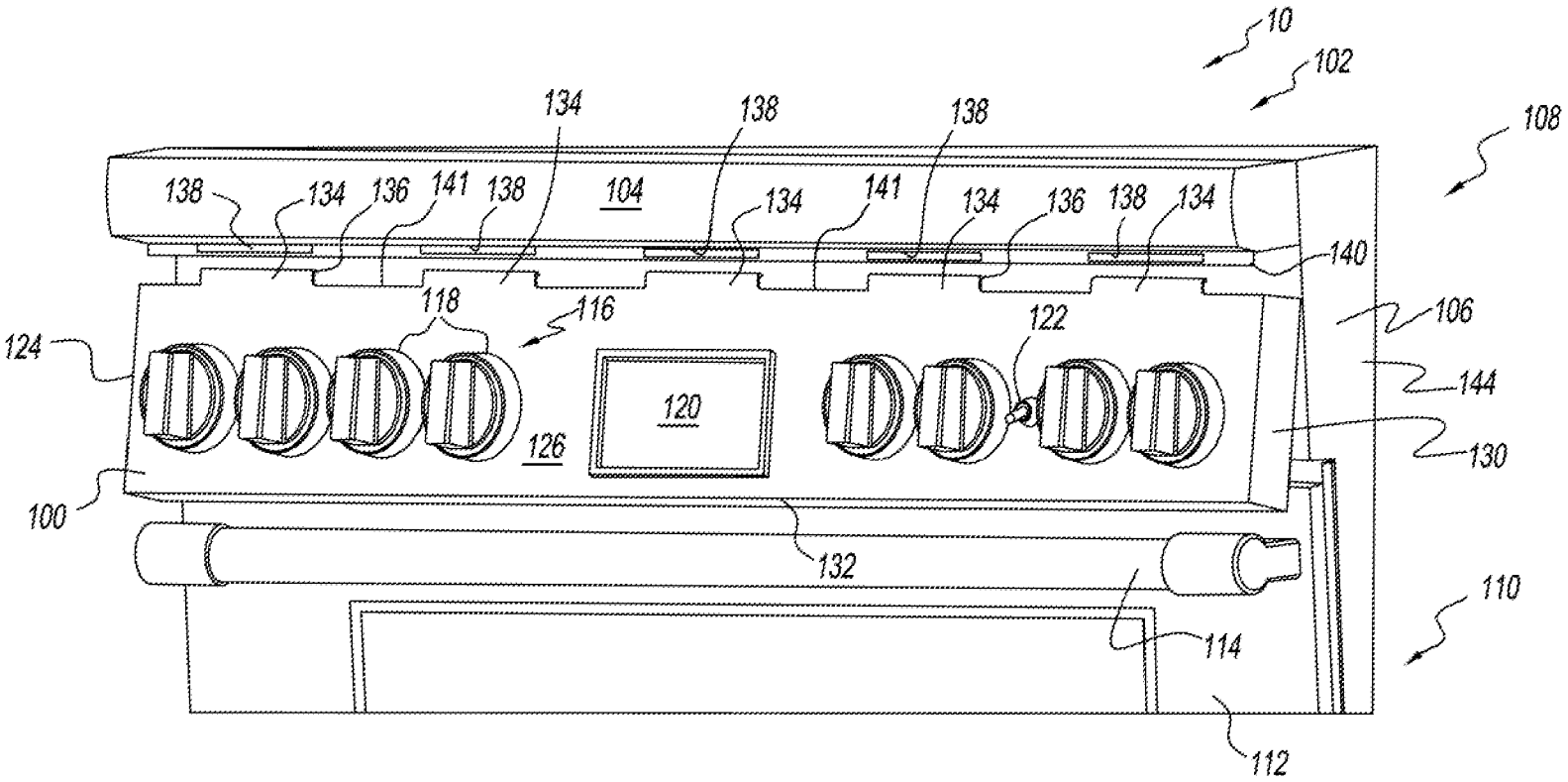
FIG. 3 is another isometric view of the stove of FIG. 2, depicting the control panel console separated from a bullnose of the stove's cooktop.
Figure 4:
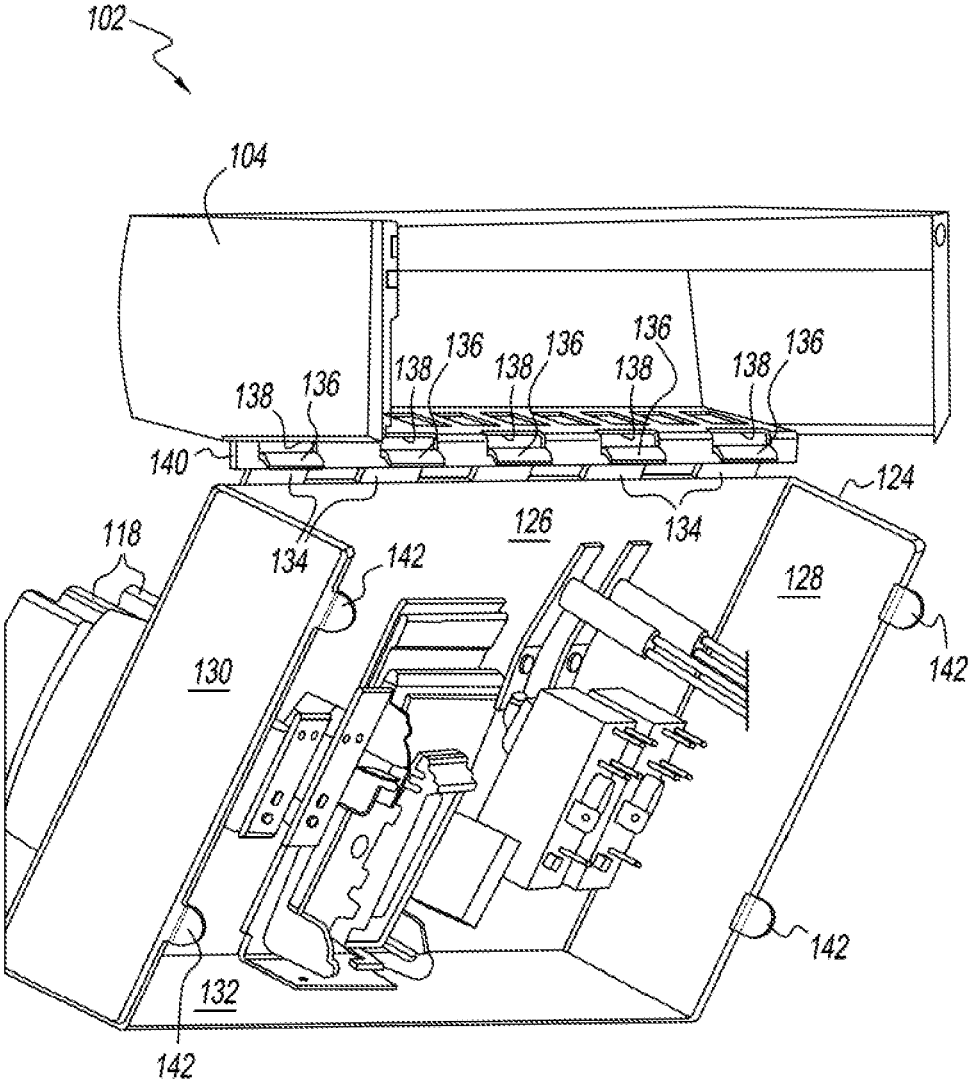
FIG. 4 is an isometric view of the bullnose and control panel console, as viewed from a rear oblique perspective.
Figure 5:
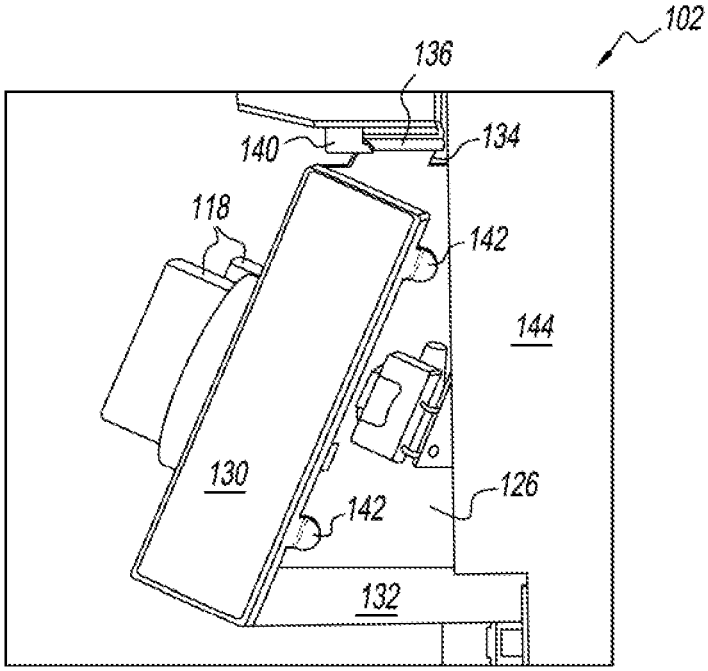
FIG. 5 is a partial rear oblique view of the control panel console tilted away from the appliance face.
Figure 6:
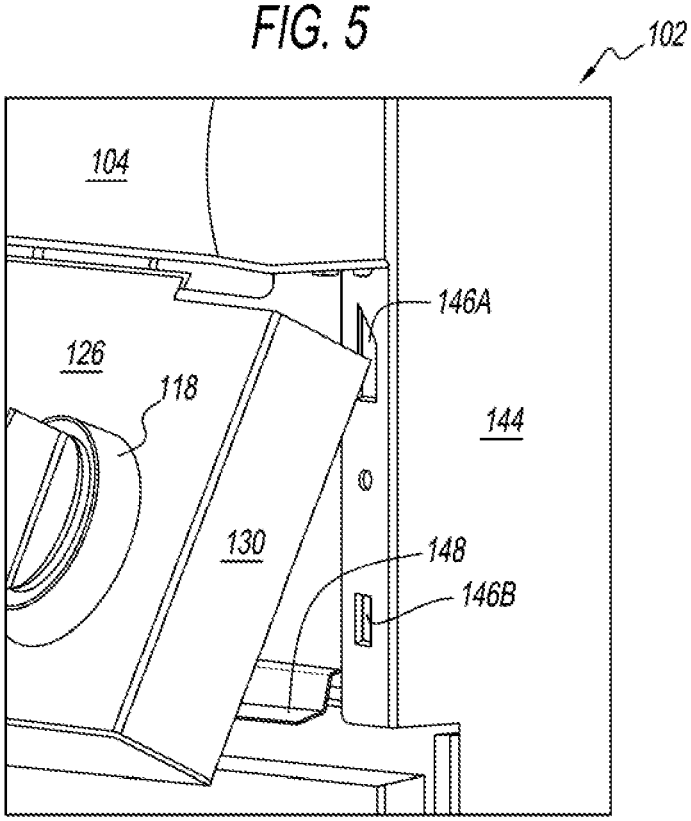
FIG. 6 is a partial front oblique view of the control panel console tilted away from the appliance face.
Figure 7:
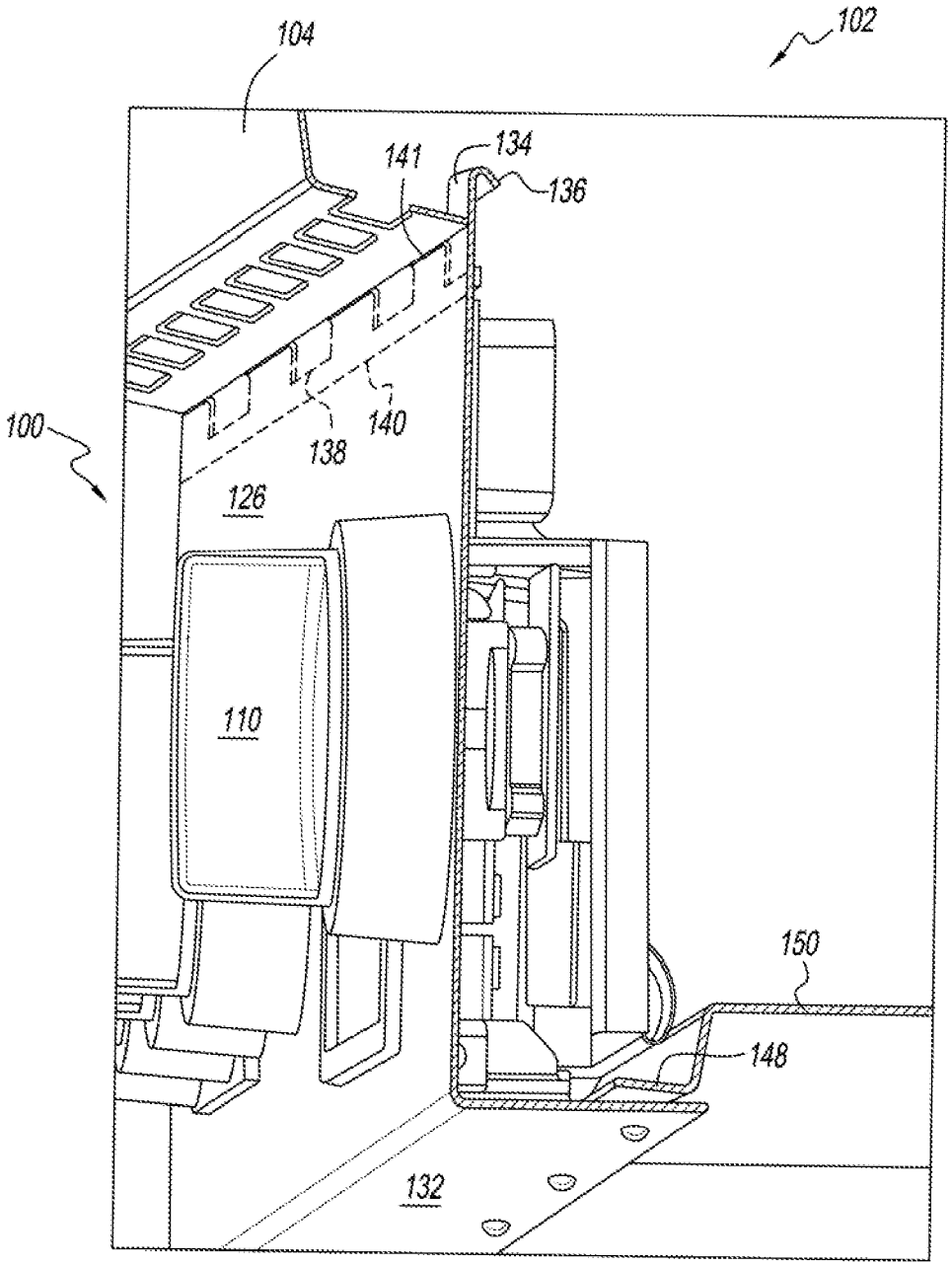
FIG. 7 is an isometric sectional view of the control panel console installed on the stove, showing relationships and orientations of various components.

FIG. 2 is an isometric view of a stove 102 comprising control panel console 100, with the control panel pivoted outward. FIG. 3 is another isometric view of stove 102, depicting control panel console 100 separated from a bullnose 104 of the stove's cooktop. FIG. 4 is an isometric view of bullnose 104 and control panel console 100, as viewed from a rear oblique perspective. FIGS. 5 and 6 depict control panel console 100 in relation to a housing 106 of the stove. FIG. 7 is an isometric sectional view of control panel console 100 installed on stove 102, showing relationships and orientations of various components.

Stove 102 includes a cooktop portion 108 having bullnose 104, and an oven portion 110 having a door 112 with a handle 114. The cooktop and oven are enclosed, at least partially, by housing 106, and control panel 100 is coupled to housing 106 and bullnose 104.

Control panel console 100 includes a plurality of user interface elements 116, such as rotatable knobs 118, display 120, and toggle switch 122, operatively connected to an exterior surface of a panel 124.

Panel 124 comprises an open-cuboid structure having a front face 126 (AKA a front wall) and three sides: a left panel portion 128, a right panel portion 130, and a bottom panel portion 132. Panel portions 128, 130, and 132 (AKA walls) extend transversely (e.g., orthogonally) rearward from front face 126, which is substantially vertical when installed on stove 102.

Front face 126 is substantially continuous across a width of the appliance, supporting rotatable knobs 34, display 36, and toggle switch 38. A plurality of fingers 134 extend from a top edge of the front face, in a castellated fashion. In this example, fingers 134 are spaced evenly across an entirety of the width of front face 126. Other suitable spacing and distribution may be utilized. Each finger 134 is bent to form a hook 136 at its distal end, as best seen in FIG. 4. Fingers 134 are configured to mate with corresponding apertures 138 in a flange 140 extending downward from a lower surface of bullnose 104. More specifically, fingers 134 are configured to be inserted through the front openings of apertures 138, and to selectively transition between (a) pivotably hanging from lower edges of the apertures by hooks 136 and (b) sliding upward such that the top edges 141 of front face 126 between the fingers abut the lower edge of bullnose 104.

With reference to FIGS. 4 and 5, left panel portion 128, right panel portion 130, and bottom panel portion 132 are coupled to front face 126, forming three sides of a box. Each panel portion and the front face comprise a sheet of material (e.g., metal, e.g., stainless steel) that is affixed to neighboring portions at right angles. The various components may be attached to each other by any suitable method, such as welding, brazing, adhesive, fasteners, and/or the like. To facilitate proper alignment of the side panels, each one includes one or more tabs 142 configured to mate with corresponding slots formed in a front face of a side wall 144 of housing 106. See FIG. 6. In this example, each of the left and right panel portions has two tabs 142 configured to be inserted into an upper slot 146A and a lower slot 146B.

As shown in FIG. 6, upper slot 146A is substantially longer or taller than lower slot 146B to facilitate installation and removal of the control panel. During removal of control panel console 100 from the appliance, a bottom end of the control panel is pivoted outward removing the bottom tab from lower slot 146B. The top tab can then slide downward in upper slot 146A, such that the finger hooks grab the lower edges of the bullnose apertures. The control panel can then be removed by unhooking the fingers. During installation, the finger hooks are hung on the lower edges of the bullnose apertures, while the top tab is substantially simultaneously inserted into upper slot 146A. The bottom of control panel console 100 is then pivoted forward and slid upward, such that the top tab slides up within its slot and the bottom tab reaches a height where it inserts into lower slot 146B. The control panel console may be selectively secured in place using fasteners in bottom panel portion 132 (see below).

Turning now to FIG. 7, with continuing reference to FIGS. 2-6, an isometric sectional view of control panel console 100 is depicted, with the control panel installed in stove 102. As shown, front face 126 of control panel console 100 is substantially vertical when fully installed.

Bullnose 104 and the upper edge of front face 126 are in contact or nearly in contact, such that any gaps at the top of the front face are minimized or eliminated. This is accomplished by displacing control panel console 100 upward, such that finger hooks 136 are extended upward, out of engagement with the lower edge of apertures 138. This displacement may be continued until top edges 141 of the front face abut the lower surface of bullnose 104. After sliding the control panel upward, or to at least partially cause the displacement, bottom panel portion 132 may be affixed to a front lip 148 of a floor 150 of the cooktop chassis. For example, one or more fasteners (e.g., threaded screws) may be inserted through the bottom panel into the lip. In some examples, clips, bolts, clamps, and/or other fasteners may be utilized.

C. Illustrative Method

Figure 8:
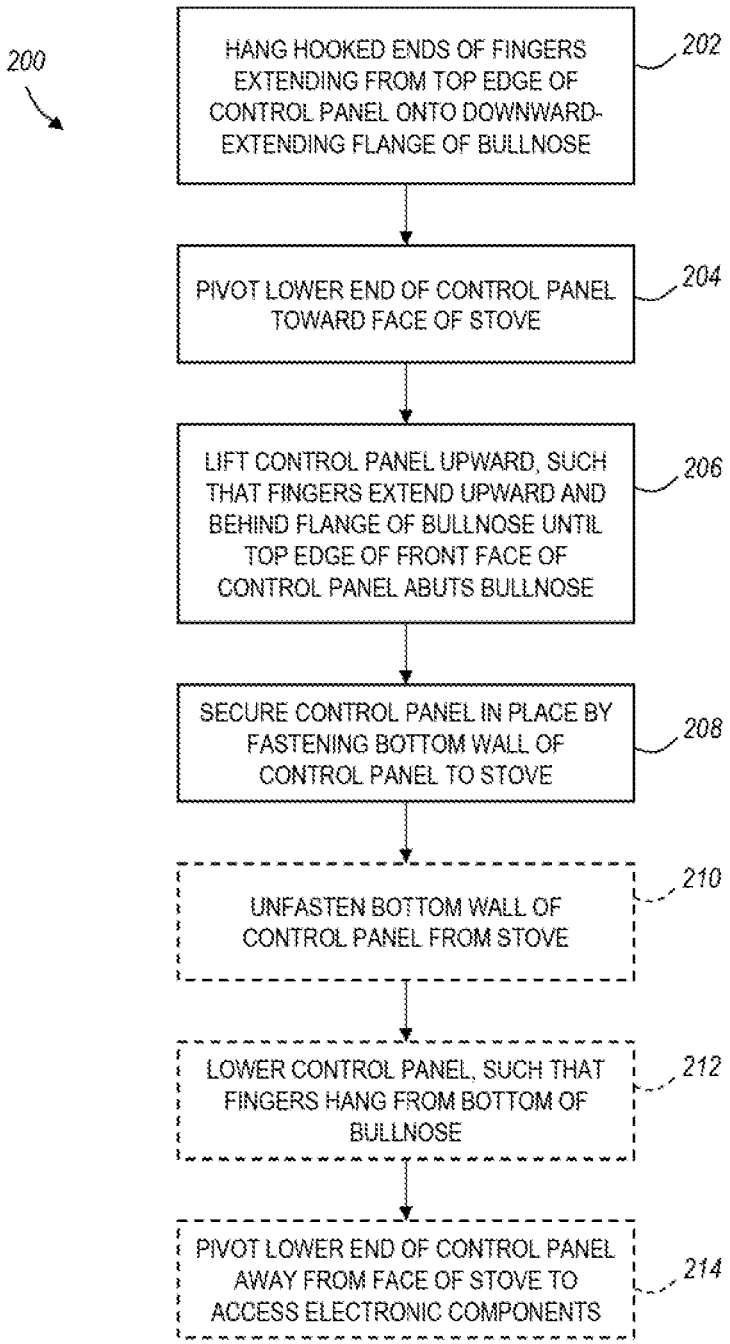
FIG. 8 is a is a flow chart depicting steps of an illustrative method for installing and/or removing a control panel console from a cooking appliance, according to the present teachings.

This section describes steps of an illustrative method 200 for installing and removing a control panel console for a cooking appliance (e.g., a range or stove); see FIG. 8. Aspects of the appliances and control panels described above may be utilized in the method steps described below. Where appropriate, reference may be made to components and systems that may be used in carrying out each step. These references are for illustration, and are not intended to limit the possible ways of carrying out any particular step of the method.

FIG. 8 is a flowchart illustrating steps performed in an illustrative method, and may not recite the complete process or all steps of the method. Although various steps of method 200 are described below and depicted in FIG. 8, the steps need not necessarily all be performed, and in some cases may be performed simultaneously or in a different order than the order shown.

Step 202 includes hanging hooked ends of one or more fingers extending from a top edge of a front face of a control panel onto bottom edges of a corresponding one or more apertures in a downward-extending flange of a bullnose of a housing of a stove, such that a lower end of the control panel is pivotable toward and away from a face of the stove.

Step 204 includes pivoting the lower end of the control panel toward the face of the stove. In some examples, pivoting the lower end of the control panel toward the face of the stove comprises inserting a first tab of the control panel into a first slot in the face of the stove.

Step 206 includes lifting the control panel upward, such that the one or more fingers move to extend upward and behind the flange of the bullnose until the top edge of the front face of the control panel abuts the bullnose. In some examples, lifting the control panel upward includes sliding the first tab upward within the first slot. In some examples, lifting the control panel upward includes inserting a second tab of the control panel into a second slot in the face of the stove. The second tab may be aligned with the second slot only after lifting the control panel upward.

Step 208 includes securing the control panel in place by fastening a bottom wall of the control panel to the stove. In some examples, fastening the bottom wall of the control panel to the stove includes inserting one or more threaded fasteners through the bottom wall and a chassis floor of a cooktop portion of the stove. The front face of the control panel may be vertical when the control panel is secured in place.

Method 200 may be stopped at this point, as the control panel has now been installed. Optional removal of the control panel continues with step 210.

Step 210 includes unfastening the bottom wall of the control panel from the stove.

Step 212 includes lowering the control panel, such that the one or more fingers hang from the bottom edges of the one or more apertures in the downward-extending flange of the bullnose.

Step 214 includes pivoting the lower end of the control panel away from the face of the stove to access one or more electronic components behind the control panel.

D. Illustrative Combinations and Additional Examples

This section describes additional aspects and features of illustrative cooking appliances having removable control panel consoles, presented without limitation as a series of paragraphs, some or all of which may be alphanumerically designated for clarity and efficiency. Each of these paragraphs can be combined with one or more other paragraphs, and/or with disclosure from elsewhere in this application, in any suitable manner. Some of the paragraphs below expressly refer to and further limit other paragraphs, providing without limitation examples of some of the suitable combinations.

A0. A cooking appliance comprising:

a stove having a cooktop mounted above an oven;

a bullnose extending from a front of the cooktop; and a removable control panel console including one or more user interface (UI) elements mounted to a front face of the control panel console and configured to control the cooktop, wherein bottom, left, and right walls extend orthogonally from the front face, and a plurality of spaced-apart fingers extend upward from a top edge of the front face, the fingers having hooked distal ends;

wherein the control panel console is transitionable between (a) a first configuration, in which the hooked distal ends of the fingers are engaged with bottom edges of corresponding apertures in a bottom flange of the bullnose, such that the bottom wall of the control panel console is free to pivot away from the stove, and (b) a second configuration, in which the top edge of the control panel console abuts a bottom of the bullnose and the bottom wall is secured to the stove.

A1. The cooking appliance of A0, wherein the bottom wall is secured to a lip of a floor of a cooktop chassis when in the second configuration.

A2. The cooking appliance of A1, wherein the bottom wall is secured to the lip by threaded fasteners.

A3. The cooking appliance of any one of paragraphs A0 through A2, wherein the left and right walls each further comprise one or more tabs configured to be received by corresponding slots in the front of the cooktop.

A4. The cooking appliance of A3, wherein each of the left and right walls includes two tabs, and an upper one of the corresponding slots in the front of the cooktop is taller than a lower one of the corresponding slots.

A5. The cooking appliance of any one of paragraphs A0 through A4, wherein the front face of the control panel console is vertical when in the second configuration.

A6. The cooking appliance of any one of paragraphs A0 through A5, wherein the one or more UI elements comprise a rotary knob.

A7. The cooking appliance of any one of paragraphs A0 through A6, wherein the cooktop is a gas cooktop.

B0. A stove comprising:

a cooktop having a cooktop chassis mounted above an oven;

a bullnose extending from a front of the cooktop, the bullnose including a downward-extending vertical flange having a plurality of spaced-apart apertures; and a removable control panel console including one or more user interface (UI) elements mounted to a front face of the control panel console and configured to control the cooktop, wherein bottom, left, and right walls extend orthogonally from the front face, one or more tabs protrude from distal edges of the left and right walls, and a plurality of spaced-apart fingers extend upward from a top edge of the front face;

wherein the fingers of the control panel console are received by the apertures of the flange of the bullnose, the tabs of the left and right walls are received in corresponding slots of the front of the cooktop, and the bottom wall of the control panel console is removably fastened to a floor of the cooktop chassis.

B1. The stove of B0, wherein the control panel console is transitionable between (a) an installed configuration, in which the top edge of the control panel console abuts a bottom of the bullnose and the bottom wall is fastened to the floor of the cooktop chassis, and (b) a removed configuration, in which the bottom wall is unfastened from the floor of the cooktop chassis and hooked distal ends of the fingers are engaged with bottom edges of the apertures in the flange, such that the bottom wall of the control panel console is free to pivot away from the stove.

B2. The stove of B0 or B1, wherein the console is removably fastened to a front lip of the floor of the cooktop chassis.

B3. The stove of B2, wherein the console is removably fastened to a front lip of the floor of the cooktop chassis by one or more threaded fasteners.

B4. The stove of any one of paragraphs B0 through B3, wherein each of the left and right walls includes two tabs, and an upper one of the corresponding slots in the front of the cooktop is taller than a lower one of the corresponding slots.

B5. The cooking appliance of any one of paragraphs B0 through B4, wherein the front face of the control panel console is vertical.

B6. The cooking appliance of any one of paragraphs B0 through B5, wherein the one or more UI elements comprise a rotary knob.

B7. The cooking appliance of any one of paragraphs B0 through B6, wherein the cooktop is a gas cooktop.

C0. A method for selectively coupling a control panel to a cooking appliance, the method comprising:

hanging hooked ends of one or more fingers extending from a top edge of a front face of a control panel onto bottom edges of a corresponding one or more apertures in a downward-extending flange of a bullnose of a housing of a stove, such that a lower end of the control panel is pivotable toward and away from a face of the stove;

pivoting the lower end of the control panel toward the face of the stove;

lifting the control panel upward, such that the one or more fingers extend upward and behind the flange of the bullnose until the top edge of the front face of the control panel abuts the bullnose; and securing the control panel in place by fastening a bottom wall of the control panel to the stove.

C1. The method of C0, wherein fastening the bottom wall of the control panel to the stove includes inserting one or more threaded fasteners through the bottom wall and a chassis floor of a cooktop portion of the stove.

C2. The method of C0 or C1, wherein the front face of the control panel is vertical when the control panel is secured in place.

C3. The method of any one of paragraphs C0 through C2, wherein pivoting the lower end of the control panel toward the face of the stove comprises inserting a first tab of the control panel into a first slot in the face of the stove.

C4. The method of C3, wherein lifting the control panel upward includes sliding the first tab upward within the first slot.

C5. The method of C3, wherein lifting the control panel upward includes inserting a second tab of the control panel into a second slot in the face of the stove.

C6. The method of C5, wherein the second tab is aligned with the second slot only after lifting the control panel upward.

C7. The method of any one of paragraphs C0 through C6, further comprising:

unfastening the bottom wall of the control panel from the stove;

lowering the control panel, such that the one or more fingers hang from the bottom edges of the one or more apertures in the downward-extending flange of the bullnose; and pivoting the lower end of the control panel away from the face of the stove to access one or more electronic components behind the control panel.

Advantages, Features, and Benefits

The different embodiments and examples of the cooking appliances with removable control panel consoles described herein provide several advantages over known solutions. For example, illustrative embodiments and examples described herein facilitate vertical and horizontal alignment using spaced apart fingers and tabs.

Additionally, and among other benefits, illustrative embodiments and examples described herein allow for easy installation and removal, providing straightforward access to electronics and other components disposed behind the control panel console.

Additionally, and among other benefits, illustrative embodiments and examples described herein allow supported pivoting of the control panel console when in a partially removed or partially installed state, freeing the hands of the technician to connect or disconnect components.

No known system or device can perform these functions. However, not all embodiments and examples described herein provide the same advantages or the same degree of advantage.

CONCLUSION

The disclosure set forth above may encompass multiple distinct examples with independent utility. Although each of these has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only. The subject matter of the disclosure includes all novel and nonobvious combinations and subcombinations of the various elements, features, functions, and/or properties disclosed herein. The following claims particularly point out certain combinations and subcombinations regarded as novel and nonobvious. Other combinations and subcombinations of features, functions, elements, and/or properties may be claimed in applications claiming priority from this or a related application. Such claims, whether broader, narrower, equal, or different in scope to the original claims, also are regarded as included within the subject matter of the present disclosure.

What is claimed is:

1. A cooking appliance comprising:

a stove having a cooktop mounted above an oven;

a bullnose extending from a front of the cooktop; and a removable control panel console including one or more user interface (UI) elements mounted to a front face of the control panel console and configured to control the cooktop, wherein bottom, left, and right walls extend orthogonally from the front face, and a plurality of spaced-apart fingers extend upward from a top edge of the front face, the fingers having hooked distal ends;

wherein the control panel console is transitionable between (a) a first configuration, in which the hooked distal ends of the fingers are engaged with bottom edges of corresponding apertures in a bottom flange of the bullnose, such that the bottom wall of the control panel console is free to pivot away from the stove, and (b) a second configuration, in which the top edge of the control panel console abuts a bottom of the bullnose and a top surface of the bottom wall is secured to a bottom surface of a lip of a floor of a cooktop chassis of the stove; and wherein the lip extends toward the front face at a level below the floor of the cooktop chassis.

2. The cooking appliance of claim 1, wherein the left and right walls each further comprise one or more tabs configured to be received by corresponding slots in the front of the cooktop.

3. The cooking appliance of claim 2, wherein each of the left and right walls includes two tabs, and an upper one of the corresponding slots in the front of the cooktop is taller than a lower one of the corresponding slots.

4. The cooking appliance of claim 1, wherein the front face of the control panel console is vertical when in the second configuration.

5. The cooking appliance of claim 1, wherein the cooktop is a gas cooktop.

6. A stove comprising:

a cooktop having a cooktop chassis mounted above an oven;

a bullnose extending from a front of the cooktop, the bullnose including a downward-extending vertical flange having a plurality of spaced-apart apertures; and a removable control panel console including one or more user interface (UI) elements mounted to a front face of the control panel console and configured to control the cooktop, wherein bottom, left, and right walls extend orthogonally from the front face, one or more tabs protrude from distal edges of the left and right walls, and a plurality of spaced-apart fingers extend upward from a top edge of the front face;

wherein the fingers of the control panel console are received by the apertures of the flange of the bullnose, the tabs of the left and right walls are received in corresponding slots of the front of the cooktop, and a top surface of the bottom wall of the control panel console is removably fastened to a bottom surface of a stepped lip extending forward and downward from a floor of the cooktop chassis, such that a front edge of the lip is lower than the floor.

7. The stove of claim 6, wherein the control panel console is transitionable between (a) an installed configuration, in which the top edge of the control panel console abuts a bottom of the bullnose and the bottom wall is fastened to the floor of the cooktop chassis, and (b) a removed configuration, in which the bottom wall is unfastened from the floor of the cooktop chassis and hooked distal ends of the fingers are engaged with bottom edges of the apertures in the flange, such that the bottom wall of the control panel console is free to pivot away from the stove.

8. The stove of claim 6, wherein the console is removably fastened to a front lip of the floor of the cooktop chassis.

9. The stove of claim 6, wherein each of the left and right walls includes two tabs, and an upper one of the corresponding slots in the front of the cooktop is taller than a lower one of the corresponding slots.

10. The stove of claim 6, wherein the front face of the control panel console is vertical.

11. The stove of claim 6, wherein the one or more UI elements comprise a rotary knob.

12. The stove of claim 6, wherein the cooktop is a gas cooktop.

* * * * *